US011833112B2

(12) United States Patent
Dworkin et al.

(10) Patent No.: US 11,833,112 B2
(45) Date of Patent: Dec. 5, 2023

(54) APPARATUS FOR OPTICALLY COUNTING DISCRETE OBJECTS

(71) Applicant: Electronic Engineering LLC, Matawan, NJ (US)

(72) Inventors: Samuel Dworkin, Matawan, NJ (US); Emily Dworkin, Matawan, NJ (US)

(73) Assignee: Electronic Engineering LLC, Matawan, NJ (US)

( * ) Notice: Subject to any disclaimer, the term of this patent is extended or adjusted under 35 U.S.C. 154(b) by 352 days.

(21) Appl. No.: 16/880,816

(22) Filed: May 21, 2020

(65) Prior Publication Data

US 2021/0361530 A1 Nov. 25, 2021

(51) Int. Cl.

| | |
|---|---|
| ***A61J 7/02*** | (2006.01) |
| ***A61J 7/00*** | (2006.01) |
| ***G06M 11/00*** | (2006.01) |

(52) U.S. Cl.

CPC ..... *A61J 7/02* (2013.01); *A61J 7/0076* (2013.01); *G06M 11/00* (2013.01); *A61J 2200/70* (2013.01); *A61J 2205/40* (2013.01)

(58) Field of Classification Search

CPC ..... A61J 7/02

See application file for complete search history.

(56) References Cited

U.S. PATENT DOCUMENTS

| | | | | |
|---|---|---|---|---|
| 5,317,645 | A * | 5/1994 | Perozek | G06M 11/00 382/141 |
| 5,768,327 | A * | 6/1998 | Pinto | G06M 1/00 377/7 |
| 6,370,215 | B1 | 4/2002 | Pinto et al. | |
| 6,824,011 | B1 * | 11/2004 | Woempner | F41B 11/50 221/265 |
| 7,086,644 | B2 * | 8/2006 | Silverbrook | B41J 29/393 271/42 |
| 2012/0267541 | A1 * | 10/2012 | Utukuri | G01S 3/784 250/394 |

* cited by examiner

*Primary Examiner* — Gene O Crawford
*Assistant Examiner* — Ayodeji T Ojofeitimi
(74) *Attorney, Agent, or Firm* — GORDON & JACOBSON, P.C.

(57) ABSTRACT

The present invention discloses an apparatus for counting discrete objects, said apparatus comprises of a hopper 1; an incline feeder 2 containing an inlet and an outlet; a single optical zone that allows detection of the discrete objects 10 entering from the feeder outlet; a controller which provides the count of the discrete objects; a screen for displaying the count of the discrete objects; wherein the incline feeder outlet is arranged orthogonally to the optical zone. The present invention discloses a method for counting discrete objects comprising the steps of inputting the discrete objects 10 into the hopper 1; passing the discrete objects through the incline feeder 2 such that they enter into the optical zone; optical zone sensing the entering discrete object 10 and transmitting a signal to the controller; displaying the count on a screen; dispensing the counted discrete objects.

19 Claims, 1 Drawing Sheet

APPARATUS FOR OPTICALLY COUNTING DISCRETE OBJECTS

FIELD OF INVENTION

The present invention relates to an apparatus and a method for counting discrete objects, which is particularly useful for dispensing or packaging a fixed number of pills into vials or bottles. The present invention relates to an apparatus for optically counting discrete objects.

BACKGROUND

Optical pill counters work by detecting each discrete object that passes its optical sensor. In a typical optical counter, pills that are poured into the top of a chute are detected by an optical sensor as they pass multiple optical zones. The apparatus reads the total pills counted when the last of the pills are through. The optical zone that scan the discrete objects usually comprises of a source side which comprises of an illuminating means and a receiver side which comprises of a sensor that sends a signal to a controller.

Manual feeding of the discrete objects into the pill counter results in a chaotic entry of said objects into the optical zone. Such a method also has the additional disadvantage of resulting in false positives due to shadows of the discrete objects. Thus, in order to obtain an accurate count of discrete objects, most of the manual feed optical counters use at least two or more optical arrays generating two or more projections of the count, with the highest count considered as the final count displayed on the screen.

U.S. Pat. Ser. No. 5,768,327 discloses an apparatus for optically counting discrete objects comprising a pair of linear optical sensor arrays arranged along orthogonal sides of the feeding channel and a corresponding pair of illuminating source arranged along the opposite adjacent sides of the feeding channel such that each sensor in each array receives light from the corresponding light source. Each of the sensor arrays sends a count to the controller and the higher of the two conservative counts is accepted as the accurate count and is displayed on a numeric display. The patent further discloses a third and fourth sensor arrays and corresponding light sources located downstream of the first and second arrays. The outputs of each of the sensor arrays are processed separately and the highest conservative count is accepted as the accurate count and is displayed on a numeric display. By design, these optical counters are prone to inaccuracies and errors due to false positives and require two or more sets of optical arrays and accordingly two or more projections of the count of discrete objects from each array for counting.

The present invention overcomes the disadvantages of optical counters that use manual feeding and accurately counts discrete objects with a single projection of the count instead of using several projections. The apparatus according to the invention only requires a single illuminating array and a single sensing array and enables a user to count discrete objects using a novel approach in an accurate and quick manner. The present invention also provides an apparatus for counting discrete objects with different shapes and different materials with good accuracy and speed without the need for multiple count projections from multiple photo arrays.

SUMMARY

The present invention discloses an apparatus for counting discrete objects, said apparatus comprises of a hopper 1; an incline feeder 2 containing an inlet and an outlet; a single optical zone that allows detection of the discrete objects 10 entering from the feeder outlet; a controller which provides the count of the discrete objects; a screen for displaying the count of the discrete objects; wherein the incline feeder outlet is arranged orthogonally to the optical zone. The present invention discloses a method for counting discrete objects comprising the steps of inputting the discrete objects 10 into the hopper 1; passing the discrete objects through the incline feeder 2 such that they enter into the optical zone; optical zone sensing the entering discrete object 10 and transmitting a signal to the controller; displaying the count on a screen; dispensing the counted discrete objects.

DESCRIPTION OF THE PREFERRED EMBODIMENT

The invention is defined with reference to the appended claims and figures. With respect to the claims, the glossary below provides the definitions.

The preferred embodiment of the present invention comprises of a hopper 1, an incline feeder 2, a single optical zone, a controller, a receptacle 11 for collecting the counted objects, and a screen for displaying the count of the discrete objects.

A Hopper 1 according to the invention comprises of a receptacle for delivering discrete objects to the incline feeder 2. The hopper 1 has a cooperating means therewith by which it may be attached to the incline feeder 2. A hopper 1 according to the invention provides an inlet to feed the discrete objects 10 onto the incline feeder. In a preferred embodiment, a user feeds discrete objects that are to be counted into the hopper 1, and the objects move onto the incline feeder 2. The hopper 1 according to the invention may be differently sized with a means to conveniently detach and attach therewith. More specifically, a hopper 1 with a smaller internal width maybe used for processing smaller discrete objects and a hopper with a larger internal width maybe used for processing relatively larger discrete objects. For example, if the user is measuring small tablets, he may attach a hopper with a smaller internal width.

Figure 1:
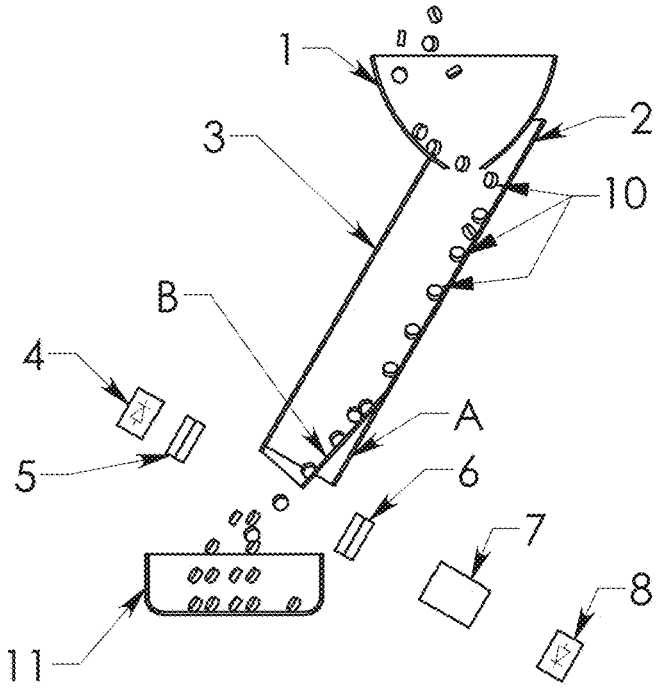
FIG. 1 shows the apparatus for optically counting discrete objects as embodied by the present invention.

The incline feeder 2 according to the invention has a substantially inclined surface comprising of a chute body having an upper chute portion with an open inlet end, and a lower chute potion with an open discharge end. The upper chute portion has a cooperating means therewith by which it may be attached to the Hopper 1. The lower discharge end is situated orthogonally to the optical zone. The incline feeder 2 further comprises of an optional safety cover 3 to protect the discrete objects from dust and the surrounding atmosphere. In a preferred embodiment of the invention, the discrete objects 10 fed into the hopper 1 enter on to the inclined surface of the feeder 2 through its upper chute portion through the open inlet, move to the lower chute potion, and exit the feeder through the open discharge end, to enter the optical zone. The inclined surface of the feeder 2 can be orientated offset from vertical between the inlet of the feeder 2 and the optical zone, and the discharge end or outlet of the incline feeder can be offset laterally from the inlet of the feeder 2 before entering the optical zone as shown in FIG. 1. In a preferred embodiment, the incline feeder 2 may be situated in a manner that allows the discrete objects exiting the feeder to enter into the optical zone in a controlled manner. In a preferred embodiment, the incline feeder 2 prevents chaotic entry of the discrete objects into the optical zone. The incline feeder 2 of the present invention facilities dispersing the discrete objects moving into the optical zone and thereby reduces false positives resulting from shadows of the discrete objects. The incline feeder 2 of the invention may have differently shaped discharge ends. For example, the incline feeder may have a lower chute portion that ends as a rounded discharge end B. In an alternate embodiment, the incline feeder 2 may have a lower chute portion that ends as a straight discharge end A. In an embodiment of the invention, the incline angle of the feeder 2 may be customized to control the separation distance between consecutive discrete objects or the rate of objects entering the optical zone to allow for an optimal counting process.

Figure 2:
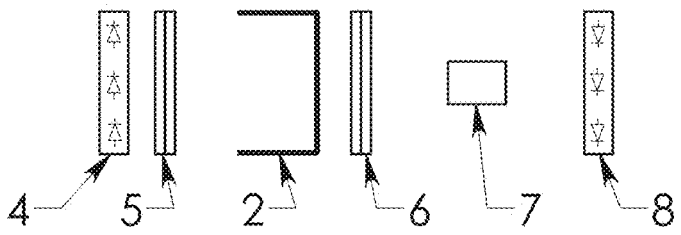
FIG. 2 shows the optical zone that comprises of a single source side and a receiver side, where the receiver side comprises of a lens 7 and an image sensor 8.
Figure 3:
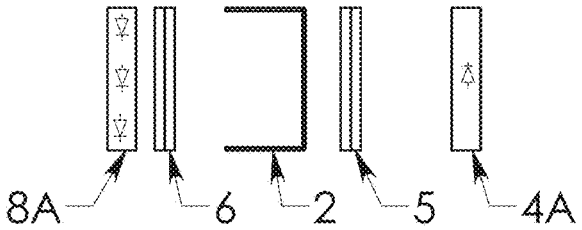
FIG. 3 shows the optical zone that comprises of a receiver side with a large optical image sensor 8A.

The optical zone according to the invention comprises of at least one source side and at least one receiver side located on opposite sides of each other, such that the light from the source side may be received by the sensor on the receiver side. The optical zone according to the invention is arranged orthogonally to the discharge end of the incline feeder. In a preferred embodiment of the present invention, the optical zone comprises of a single source side and a single receiver side, and is arranged orthogonally to the discharge end of the incline feeder. The source side according to the invention comprises of a linear radiation source 4 that produces visible, ultraviolet or infra-red light radiation. Filters may be added to isolate the desired type of radiation from the light spectrum. Different kinds of filters may be employed towards this end such as filters which decrease the optical noise, polarized light, infra-red light, visible light or variety of transmission bands. In a preferred embodiment, the linear radiation source 4 maybe filtered via filter 5 on the source side and another filter 6 on the receiver side such that they result in isolating a single type of desired radiation beam. The desired radiation beam is selected based on the type of discrete object to be counted. In this embodiment, the filters decreases optical noise, duplicate counting of a discrete object, polarized light, infra-red light, visible light and variety of transmission bands. The optical zone according to the invention is depicted in FIG. 1, 2 or 3.

The receiver side according to the invention comprises of a lens 7, and a miniature image sensor 8. In this embodiment, as shown in FIG. 1 and FIG. 2, lens 7 projects image of the discrete objects to the image sensor 8 and the image sensor has the means to transmit said signal to a controller. In an alternative embodiment, the receiver side comprises of a large optical image sensor 8A. In this embodiment, as shown in FIG. 3, the large image sensor 8A has the same width as that of the feeder outlet and detects the shadows of the discrete objects projected onto it, and transmits the signal to the controller. In a preferred embodiment, a desired radiation beam from the source side 4 is received by the sensor 8, 8A on the receiver side. The discrete objects that enters the path of the beam is detected by the receiver side and a signal is transmitted to the controller.

In a preferred embodiment of the invention a discrete object fed into the hopper 1 moves onto the incline surface of the feeder 2 and enters into the optical zone. The optical zone detects the presence of the object and transmits the signal to the controller. A receptacle 11 or a bowl collects the discrete objects exiting from the optical zone.

The controller according to the invention is a central unit which receives input from the image sensor and has the means to record the number of discrete objects corresponding to said signal from image sensor. In an embodiment of the invention, the controller may be used in combination with a software to record the objects passing the optical zone. The controller further has a means to transmit said count of discrete objects to the display screen. The display screen according to the invention displays the number of discrete objects as recorded by the controller.

The software according the invention may be any of the marketed software programs that recognize, record and/or display the count on the display screen. In an alternate embodiment, the software according to the invention may be uniquely developed for the apparatus of the present invention to serve the specific goals of the users.

In a preferred embodiment, the method of counting discrete objects comprises the steps of: inputting the discrete objects 10 into the hopper; moving the discrete objects through the inclined surface of the feeder 2 such that they enter into the optical zone; detection of the discrete object at the optical zone and transmitting said detection from the image sensor to the controller; displaying the count of discrete objects on a screen and collection of the discrete objects in a receptacle 11, bowl or a dispensing container. A user may thereby dispense a required number of counted objects into a container ready for dispensing.

In an embodiment of the invention, the optical counting apparatus may be enclosed in a housing, which housing comprises means for protecting the apparatus from dust and outside environment.

The discrete objects according to the invention are tablets, capsules or other small pharmaceutical products. In a specific embodiment of the invention, the discrete objects are tablets. In an alternate embodiment of the invention, the discrete objects of the invention are metal parts.

While the invention has been described above with reference to specific embodiments thereof, it is apparent that many changes, modifications, and variations can be made without departing from the inventive concept disclosed herein, and such description is not intended as limitations on the scope thereof. Accordingly, it is intended to embrace all such changes, modifications, and variations that fall within the spirit and broad scope of the appended claims.

What is claimed is:

1. An apparatus for counting discrete objects, said apparatus comprising:

a manual feed hopper;

an incline feeder having an inlet and an outlet, wherein the inlet is operably coupled to the hopper, and wherein discrete objects are adapted to be received from the manual feed hopper into the incline feeder in a chaotic flow, and the incline feeder has an inclined surface configured to guide and organize movement of the discrete objects;

an optical zone consisting of a single illumination source side and a single sensor receiver side cooperating with the illumination source side, wherein the outlet of the incline feeder is configured to deliver the discrete objects to the optical zone, and wherein the inclined surface is orientated offset from vertical between the inlet and the optical zone, such that discrete objects entering the inlet enter onto the inclined surface, and the optical zone is configured to detect discrete objects entering the optical zone from the outlet of the incline feeder;

a controller configured to provide a count of the discrete objects; and a screen for displaying the count of the discrete objects;

wherein the outlet of the incline feeder is disposed above the optical zone.

2. The apparatus of claim 1, wherein the incline feeder further comprises a safety cover.

3. The apparatus according to claim 1, wherein the outlet of the incline feeder is arranged orthogonally to the optical zone.

4. The apparatus according to claim 1, wherein the outlet of the incline feeder is offset laterally from the inlet of the incline feeder.

5. The apparatus according to claim 1, wherein the orientation of the incline feeder is customized to control separation distance between consecutive discrete objects or a rate of discrete objects entering the optical zone.

6. The apparatus of claim 1, wherein the illumination source side comprises of a radiation source.

7. The apparatus of claim 6 , wherein the radiation source is selected from a visible light source, an ultraviolet light source, and an infra-red light source.

8. The apparatus of claim 2, wherein the sensor receiver side comprises of:

a lens; and an image sensor, wherein the lens projects images corresponding to the discrete objects onto the image sensor, and wherein the image sensor sends a signal to the controller.

9. The apparatus of claim 7, wherein the radiation source is filtered on the illumination source side and/or the sensor receiver side; wherein such filtration decreases at least one of optical noise, duplicate counting of a discrete object, polarized light, infra-red light, visible light and variety of transmission bands.

10. The apparatus of claim 2, wherein the sensor receiver side comprises an image sensor configured to detect shadows of the discrete objects projected onto it, and sends the signal to the controller.

11. The apparatus of claim 10, wherein the image sensor has the same width as that of the outlet of the incline feeder.

12. The apparatus of claim 1, wherein the controller is used in combination with software.

13. The apparatus of claim 12, wherein the controller records the number of discrete objects and displays the number of discrete objects on the screen.

14. A method of counting discrete objects, comprising:

(i) providing the apparatus of claim 1 and inputting the chaotic flow of the discrete objects into the hopper;

(ii) passing the discrete objects from the hopper to the inlet of the incline feeder;

(iii) passing the discrete objects along the incline feeder such that the incline feeder reduces chaos in the discrete objects before they enter into the optical zone;

(iv) in the optical zone sensing the discrete objects and transmitting a signal to the controller;

(v) displaying a count of the discrete objects on a screen; and (vi) dispensing the discrete objects.

15. The apparatus of claim 14, wherein the discrete objects are tablets, capsules or other small pharmaceutical products.

16. The apparatus of claim 15, wherein the discrete objects are metal parts.

17. A method of counting discrete objects, comprising the steps of:

a) providing a feeder oriented at an incline, the feeder having an inlet and an outlet and an inclined surface oriented at an angle relative to vertical between the inlet and the outlet;

b) delivering the discrete objects in a chaotic manner into the inlet and onto the inclined surface;

c) reducing the chaos of the discrete objects on the inclined surface;

d) after the discrete objects have traveled on the inclined surface, passing the discrete objects into an optical zone where the discrete objects are automatically sensed by a sensing array consisting of a single illumination source side and a single sensor receiver side;

e) transmitting a signal of the sensed discrete object from the optical zone to a controller; and f) displaying a count of the discrete objects on a display.

18. The method of claim 17, further comprising:

dispensing the discrete objects.

19. The method of claim 17, wherein the discrete objects move in a controlled manner from the feeder into the optical zone.

* * * * *